US005907822A

United States Patent [19]

Prieto, Jr.

[11] Patent Number: 5,907,822

[45] Date of Patent: May 25, 1999

[54] LOSS TOLERANT SPEECH DECODER FOR TELECOMMUNICATIONS

[75] Inventor: Jaime L. Prieto, Jr., Torrance, Calif.

[73] Assignee: Lincom Corporation

[21] Appl. No.: 08/833,287

[22] Filed: Apr. 4, 1997

[51] Int. Cl.[6] ..... G10L 9/00; G10L 5/00

[52] U.S. Cl. ..... 704/202; 704/221; 704/226

[58] Field of Search ..... 704/202, 219, 704/221, 223, 226, 206, 259

[56] References Cited

U.S. PATENT DOCUMENTS

| | | | |
|---|---|---|---|
| 5,426,745 | 6/1995 | Baji et al. | 704/213 |
| 5,657,420 | 8/1997 | Jacobs et al. | 704/223 |
| 5,657,422 | 8/1997 | Janiszewski et al. | 704/229 |
| 5,717,822 | 2/1998 | Chen | 704/219 |
| 5,778,338 | 7/1998 | Jacobs et al. | 704/223 |

*Primary Examiner*—David R. Hudspeth
*Assistant Examiner*—Susan Wieland
*Attorney, Agent, or Firm*—Wendy K. Buskop; Bayko, Gibson et al

[57] ABSTRACT

A method and device for extrapolating past signal-history data for insertion into missing data segments in order to conceal digital speech frame errors. The extrapolation method uses past-signal history that is stored in a buffer. The method is implemented with a device that utilizes a finite-impulse response (FIR) multi-layer feed-forward artificial neural network that is trained by back-propagation for one-step extrapolation of speech compression algorithm (SCA) parameters. Once a speech connection has been established, the speech compression algorithm device begins sending encoded speech frames. As the speech frames are received, they are decoded and converted back into speech signal voltages. During the normal decoding process, pre-processing of the required SCA parameters will occur and the results stored in the past-history buffer. If a speech frame is detected to be lost or in error, then extrapolation modules are executed and replacement SCA parameters are generated and sent as the parameters required by the SCA. In this way, the information transfer to the SCA is transparent, and the SCA processing continues as usual. The listener will not normally notice that a speech frame has been lost because of the smooth transition between the last-received, lost, and next-received speech frames.

17 Claims, 15 Drawing Sheets

LOSS TOLERANT SPEECH DECODER FOR TELECOMMUNICATIONS

ORIGIN OF THE INVENTION

The present invention was made in the performance of work under a NASA contract and is subject to the provisions of Section 305 of the National Aeronautics and Space Act of 1958, Public Law 85-568 (72 Stat. 435, 42 U.S.C. 2457). The Phase I contract number was NAS 9-18870, NASA Patent Case No. MSC-22426-1-SB and the Phase II contract number is NAS 9-19108.

FIELD OF THE INVENTION

The present invention relates to telecommunication systems. More particularly, the present invention relates to a method and device that compensates for lost signal packets in order to improve the quality of signal transmission over wireless telecommunication systems and packet switched networks.

BACKGROUND OF THE INVENTION

Modern telecommunications are based on digital transmission of signals. For example, in FIG. 1, analog vocal impulses from a person 12 are sent through an analog-to-digital coder 14 that makes digital representations 16, 17 of the sender's message. The digital representation is then transmitted to a listener's receiver where the digital signal is decoded by means of a decoder 18. The decoded signal is used to activate a standard speaker in the listener's headset 20 that faithfully reproduces the sender's message. In some instances, the digital representations 16 may be lost in transit whereas other digital representations 17 arrive correctly.

Speech is sampled, quantized, and coded digitally for transmission. There are two main types of coders-decoders (codecs) used for speech signals: waveform coders, and vocoders (from voice-coders). The waveform coders attempt to approximate the original signal voltage waveform. Vocoders, on the other hand, do not try to approximate the original voltage waveform. Instead, vocoders try to encode the speech sound as perceived by the listener.

Some early waveform coder designs, such as the Abate adaptive delta-modulation codec used on the U.S. Space Shuttle, combined error mitigation in the coding of speech samples themselves. See Donald L. Schilling, Joseph Garodnick, and Harold A. Vang, "Voice Encoding for the Space Shuttle Using Adaptive Delta Modulation," IEEE Transactions on Communications, Vol. COM-26, No. 11 (November 1978). Similarly, some error-control coding schemes, such as the convolution coder, mitigate errors at the bit level.

Vocoders typically encode speech by processing speech frames between 10 to 30 ms in length, and by estimating parameters over this window based on an assumed speech production model. Additionally, the development of forward-error correction, such as Reed-Solomon, and advances in vocoder quality have led to frame-based error-control, speech coding/compression and concealment of errors.

Conventional vocoders are designed to minimize the required bit rate or bandwidth needed to transmit speech. Consequently, speech compression algorithms are used to reduce the number of bits that must be transmitted. Instead of transmitting the coded bits that represent the speech waveform, only the parameters of the speech compression algorithm are transmitted. All suitable decoders must be able to read the speech compression algorithms parameters in order to recreate the coded bits that faithfully reproduce voice messages.

Digital cellular and asynchronous networks transmit digital information (data) in the form of packets called speech frames. On occasion, digital cellular and "PCS" wireless speech communication channels lose speech frame data due to a variety of reasons, such as signal fading, signal interference, and obstruction of the signal between the transmitter and the receiver. A similar problem arises in asynchronous packet networks, when a particular speech frame is delayed excessively due to random variations in packet routing, or lost entirely in transit due to buffer overflow at intermediate nodes. The popular transport control protocol (known usually as TCP/IP, which includes the Internet Protocol header) guarantees that the packets transmitted will be received (so long as the connection remains open) in the order in which they were sent. TCP also guarantees that the data received is error-free. What TCP does not guarantee is the timeliness of the delivery of the packet. Therefore, TCP or any re-transmission scheme cannot meet the real-time delivery constraints of speech conversations. See W. R. Stevens, "TCP/IP Illustrated, Vol. 1, The Protocols," Addison-Wesley Publishing Company, Reading Mass., 1994. All of these problems result in the loss or corruption of speech frames for voice transmission. These "frame-loss" and "frame-error" conditions cause a significant drop in speech quality and intelligibility.

Prior art digital wireless telecommunication systems and asynchronous networks have employed various techniques to alleviate the degradation of speech quality due to frame-loss and frame-error. There are five techniques employed in prior art systems. These five techniques are called: "do nothing", "zero substitution," "parameter repeat," "frame repeat," and "parameter interpolation."

The "do nothing" method does just that—nothing. A corrupted speech frame is simply passed along without any attempt at error-correction or error-concealment. The decoder processes the speech data as if it were correctly received (without error), even though some of the bits are in error. Likewise, no effort is made to conceal the loss of a speech frame. The "signal" presented to the user in the case of a lost speech frame is simply that of "dead air" which sounds like static noise.

The "zero substitution" method works specifically for lost speech frames. With this technique, a period of silence is substituted for lost speech frames. Unlike the "do nothing" method, where the "dead air" sounds like static noise, the lost speech frames under the zero substitution method sound like gaps. Unfortunately, the sound gaps under the zero substitution method tend to chop up a telephone conversation and cause the listener to perceive "clicks" which they find annoying. In some cases, playing the garbled data is preferable to inserting silence for the frames in error. Furthermore, if any subsequent speech coding is performed on the information, then the effects of the error will propagate downstream of the decoder. Many low bit rate coders do use past history data to code the information.

The "parameter repeat" method simply repeats previously received coding parameters. The coding parameters come from previously received speech frame packets. In other words, the parameter repeat method simply repeats the last received frame until non-corrupted speech frames are again received. Repeating the previously received coding parameters is better than the techniques of doing nothing and inserting silence. However, listeners complain that the speech received via the parameter repeat method is synthetic, mechanical, or unnatural. If too many frames are lost, a considerable decrease in quality can be heard. Despite these drawbacks, the parameter repeat method is the most widely used frame-error concealment technique.

The "frame repeat" method is like the parameter repeat method, except that the previously received frame is repeated—in pitch—synchronously with the last-known-good speech frame. The downside to the frame repeat method is that there is usually a discontinuity at the boundary between the lost and the next received frame which causes a click to be heard by the listener. Unfortunately, real-time speech has strict end-to-end timing requirements, that make retransmission of speech frames to the receiver undesirable and impractical.

The "parameter interpolation" method receives the last-known-good speech frame and waits until the next-known-good speech frame is received. Once the next-known-good speech frame is received, an interpolation is made to create intermediate speech frame that is inserted to fill the gap in time between the last-known-good speech frame and the next-known-good speech frame. While the parameter interpolation method can yield significantly improved quality of speech, it is only effective for one lost frame (up to 30 ms) and an additional frame-delay is introduced in the decoder. The problem with this method, and all other prior art speech decoders, is that they fail to maintain acceptable speech quality when digital data is lost.

An illustration of the aforesaid techniques is shown in FIG. 2.

During the late 1980's and early 1990's, the University of Kansas Telecommunication and Information Sciences Laboratory (TISL) explored the use of priority-discarding techniques for use in congestion control in integrated (voice-data) packet networks by detecting the onset of congestion and discarding speech packets that contained "redundant" low-priority information that could "possibly" be extrapolated. See D. W. Petr, L. A. DaSilva, Jr., and V. S. Frost, "Priority Discarding of Speech in Integrated Packet Networks," IEEE Journal on Selected Areas in Communications, Vol. 7, No. 5, June 1989; and L. A. DaSilva, D. W. Petr, and V. S. Frost, "A Class-Oriented Replacement Technique for Lost Speech Packets," IEEE CH2702-9/89/0000/1098 (1989). The solution then found was based on classifying the speech packets, and developing replacement techniques for each of the four classes of speech (background noise, voiced, fricatives, and other noise). The techniques that were developed for the concealment of lost speech packets were moderately successful at maintaining the quality for background noise, fricatives, and the "other noise" classes. Unfortunately, this work did not find a lost packet replacement technique for voiced speech packets that maintained an acceptable perceived quality to the listener. An alternative voice speech packet approximation method was disclosed in a masters thesis by Jaime L. Prieto entitled "A Varying Time-Frequency Model Applied to Voiced Speech Based on Higher-Order Spectral Representations" which was published on Mar. 5, 1991. The technique disclosed in the Prieto thesis used linear-prediction as a parameter-based pitch and frequency-domain extrapolation of the spectral envelope. The linear-prediction technique was only moderately successful in generating replacement speech for lost frames and is now known as the linear-prediction magnitude and pitch extrapolation (LPMPE) technique.

There is, therefore, a need in the art for a frame-error and frame-concealment technique that improves sound quality and intelligibility. There is also a need in the art for a frame-error and frame-loss concealment technique that does not impose a time delay on real-time data transmissions. It is an object of the present invention to overcome the limitations of the prior art. It is a further object of the present invention to increase the quality of speech in a frame-error or frame-loss environment compared to all prior art frame error/loss concealment techniques.

SUMMARY OF THE INVENTION

The present invention solves the problems inherent in the prior art techniques. The present invention uses an extrapolation technique that employs past-signal history that is stored in a buffer. The extrapolation technique models the dynamics of speech production in order to conceal digital speech frame errors. The technique of the present invention utilizes a finite-impulse response (FIR) multi-layer feed-forward artificial neural network trained by back-propagation for one-step extrapolation of speech compression algorithm parameters.

Once a speech connection has been established, the speech compression algorithm (SCA) device will begin sending encoded speech frames. As the speech frames are received, they are decoded and converted back into speech signal voltages. During the normal decoding process, the present invention will pre-process the required SCA parameters and store them in a past-history buffer. If a speech frame is detected to be lost or in error, then the present invention's extrapolation modules are executed and replacement SCA parameters are generated and sent as the parameters required by the SCA. In this way, the information transfer to the SCA is transparent, and the SCA processing continues unaffected. The listener will not normally notice that a speech frame has been lost because of the smooth transition between the last-received, lost, and next-received speech frames.

DETAILED DESCRIPTION OF THE INVENTION

The present invention will work for any "channel" based system. Referring to the Open Systems Interconnect (OSI) model, the present invention functions in the "transport layer" or layer 4. See A. S. Tanenbaum, "Computer Networks," Prentice Hall, Englewood Cliffs, N.J., 1988. The transport layer provides the end-users with a pre-defined quality of service (QOS). The present invention may be used in conjunction with a speech compression algorithm (SCA) in any wireless, and packet speech communication system. The present invention should be activated at any time a digital phone is "off-hook" and when frame-errors are detected. The present invention relies on a frame-error detection service provided by the lower communication levels.

Figure 1:
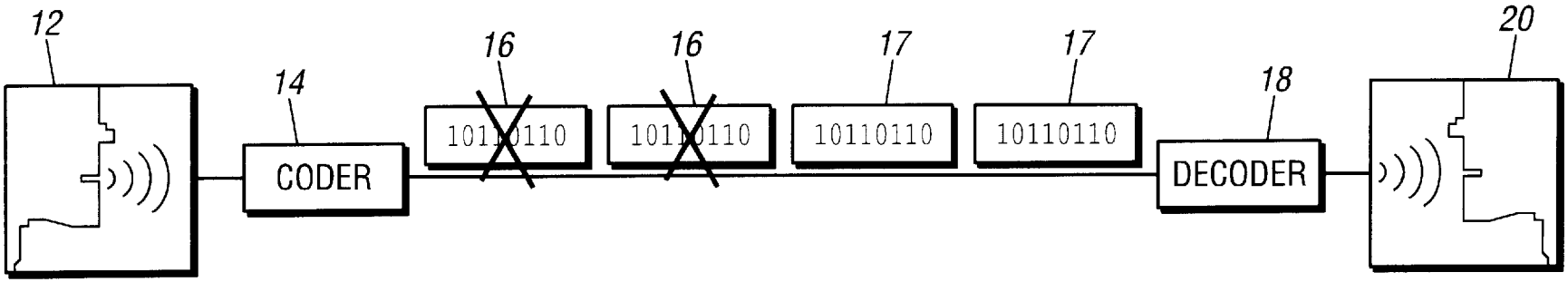
FIG. 1 (Prior Art)
FIG. 1 illustrates the loss of speech frames in the reception of digital wireless networks.
Figure 2:
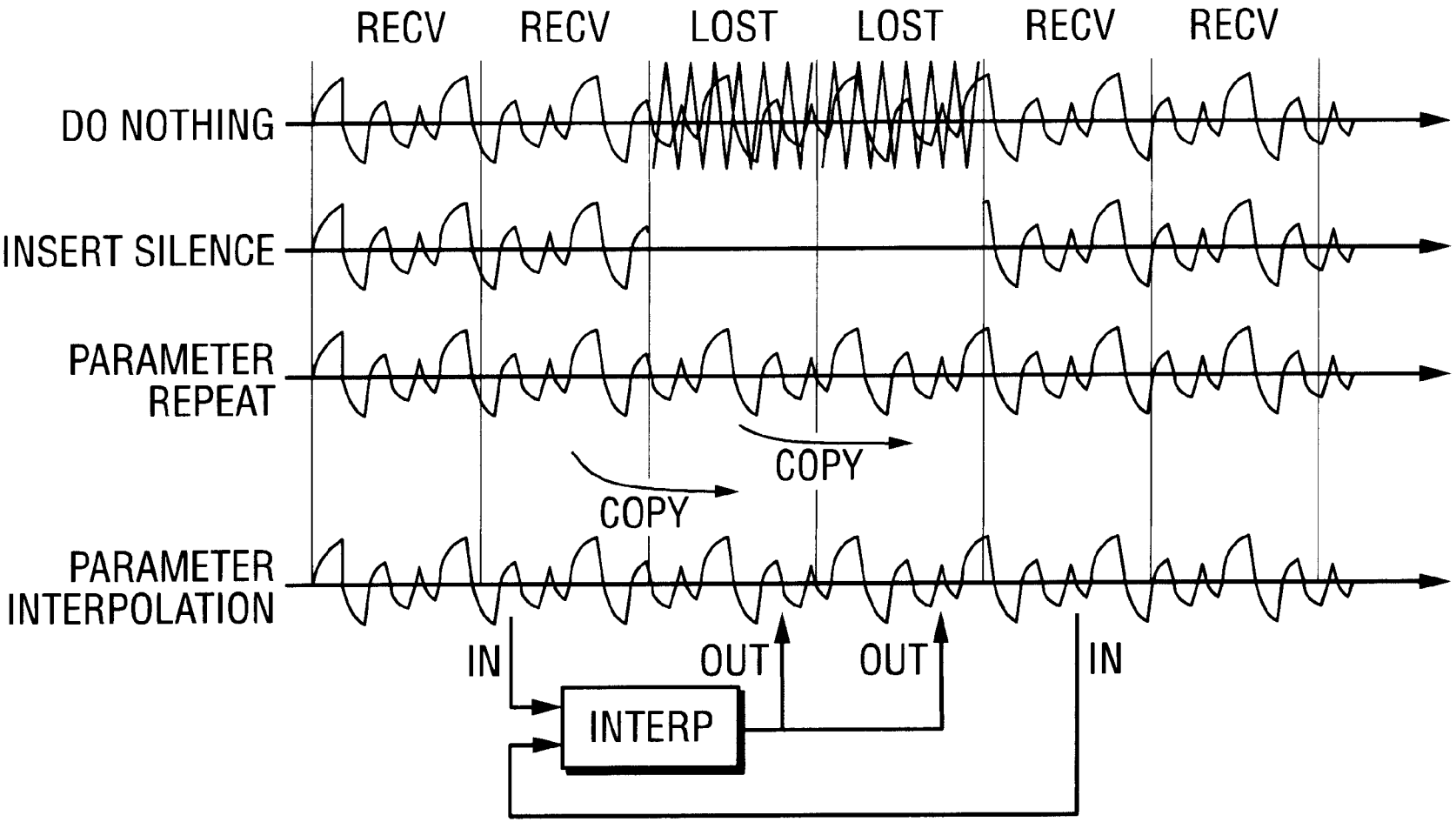
FIG. 2 (Prior Art)
FIG. 2 illustrates the prior art frame-loss concealment techniques.
Figure 3:
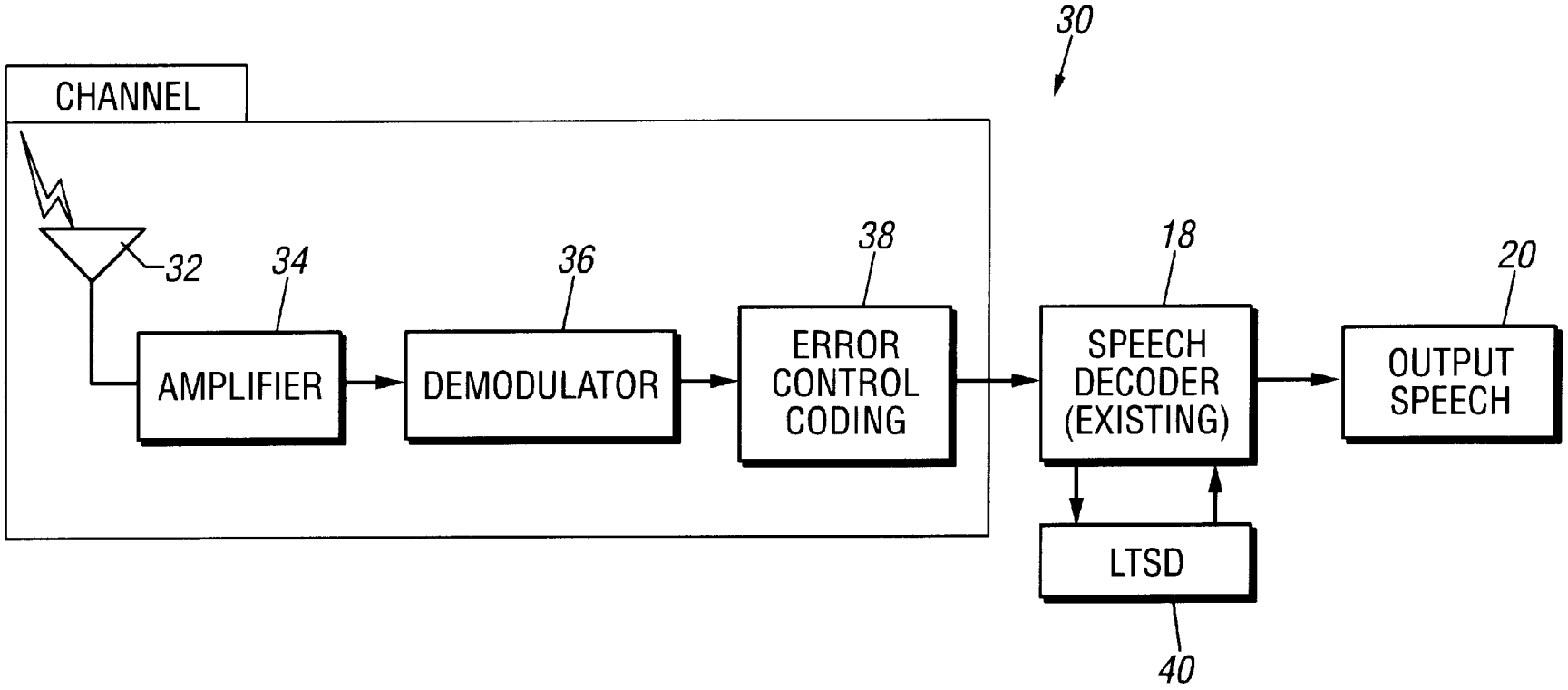
FIG. 3 illustrates a wireless telecommunication channel used with an embodiment of the present invention.

As shown in FIG. 3, the channel-based receiver system 30 has an antenna 32, an amplifier 34, a demodulator 36, and an error control coding device 38. The signal received by the antenna is processed by the amplifier 34, the demodulator 36 and is checked by the error control coding device 38. The resulting signal is then sent to the speech decoder 18 and, if the signal is received correctly, the decoder 18 decodes the signal for presentation to the listener on headset 20. The present invention 40 interacts with the speech decoder 18 by receiving a copy of the received signal from the error control coding device 38 and, in the case of a lost speech frame, extrapolating new speech frame data based upon past-history data and supplying the new data to the speech decoder 18 in order to conceal the absence of the lost speech frames.

A suitable embodiment of the present invention may be implemented on a Texas Instruments TMS320C31-based digital signal processing (DSP) board. A suitable coder for use with the present invention is the Sinusoidal Transform Coder (STC) that was developed at the Lincoln Laboratory of the Massachusetts Institute of Technology.

The STC algorithm uses a sinusoidal model with amplitudes, frequencies, and phases derived from a high resolution analysis of the short-term Fourier transform. A harmonic set of frequencies is used as a replacement for the periodicity of the input speech. Pitch, voicing, and sine wave amplitudes are transmitted to the receiver. Conventional methods are used to code the pitch and voicing, and the sine wave amplitudes are coded by fitting a set of cepstral coefficients to an envelope of the amplitude. See MA. Kohler, L. M. Supplee, T. E. Tremain, in "Progress Towards a New Government Standard 2400 BPS Voice Coder," Proceedings IEEE International Conference on Acoustics, Speech, and Signal Processing, pp. 488–491, May 1995.

Figure 4:
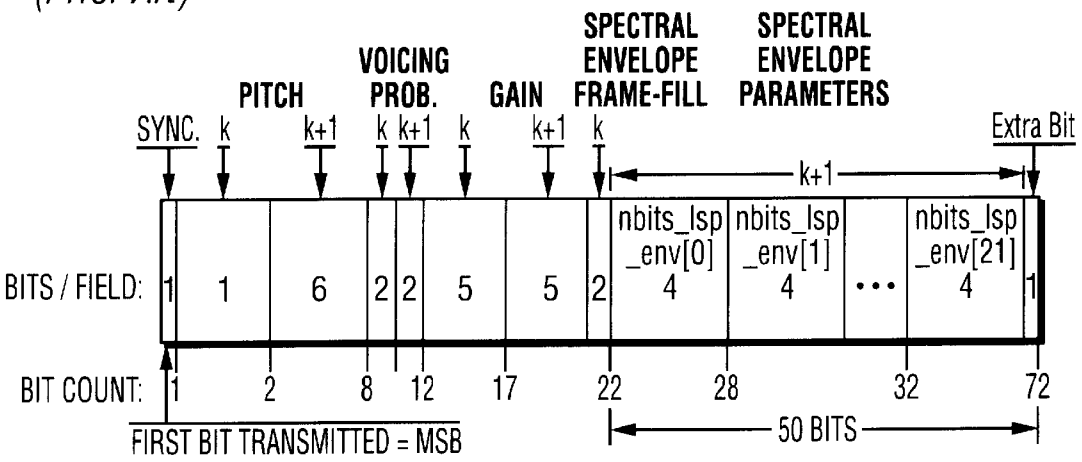
FIG. 4 (Prior Art)
FIG. 4 shows the parameters used in the prior art STC encoded bit-stream.

The STC encoded bit-stream, along with the bit allocations for each parameter, are shown in FIG. 4. Note that an STC frame is generated every 30 ms. The total size of the STC frame is 72 bits, so the coding rate is indeed 2400 bps. See R. J. McAulay, T. F. Quatieri, "The Application of Subband Coding to Improve Quality and Robustness of the Sinusoidal Transform Coder," Proceedings IEEE International Conference on Acoustics, Speech and Signal Processing, pp. II-439–II-446, April 1993; R. J. McAulay, T. F. Quatieri, "The Sinusoidal Transform Coder at 2400 b/s," IEEE 0-7803-0585-X/92 15.6.1 to 15.6.3, 1992.

Figure 5:
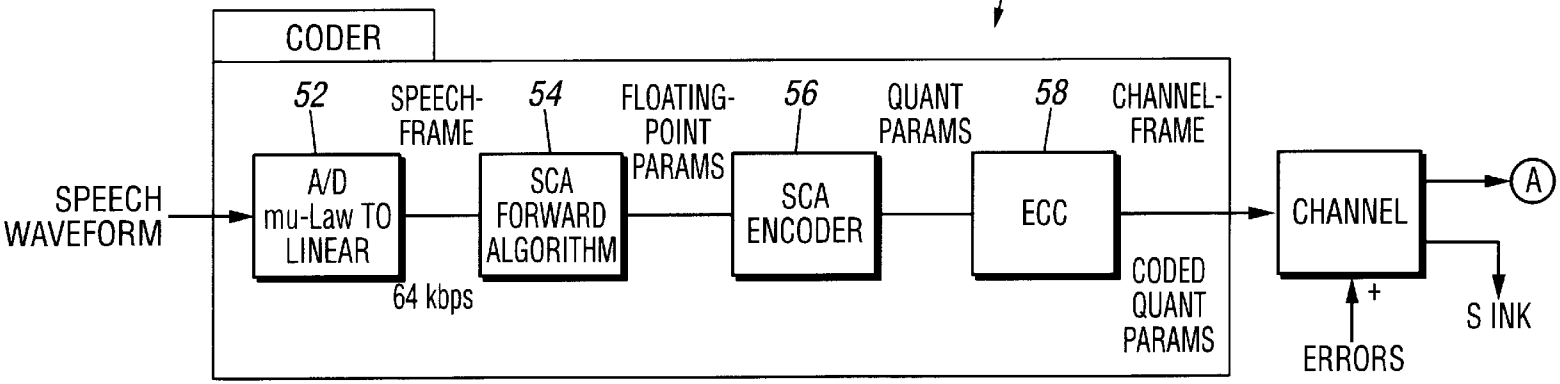
FIG. 5 (Prior Art)
FIG. 5 illustrates the functional relationship of elements of the prior art STC.

FIG. 5 shows the general functions of the encoding side of the digital transmission. The prior art coder 50 has an analog-to-digital converter 52 that digitizes the speech waveform. The digitized speech frame is then sent through the speech compression algorithm 54 in order to reduce the number of bits needed to be transmitted. The speech compression algorithm 54 produces floating point parameters that represent the speech waveform. Next, the floating point parameters are encoded by the speech compression algorithm encoder 56. Finally, the quantized parameters are broadcast onto the channel (in channel-frame format) by ECC 58.

Figure 6:
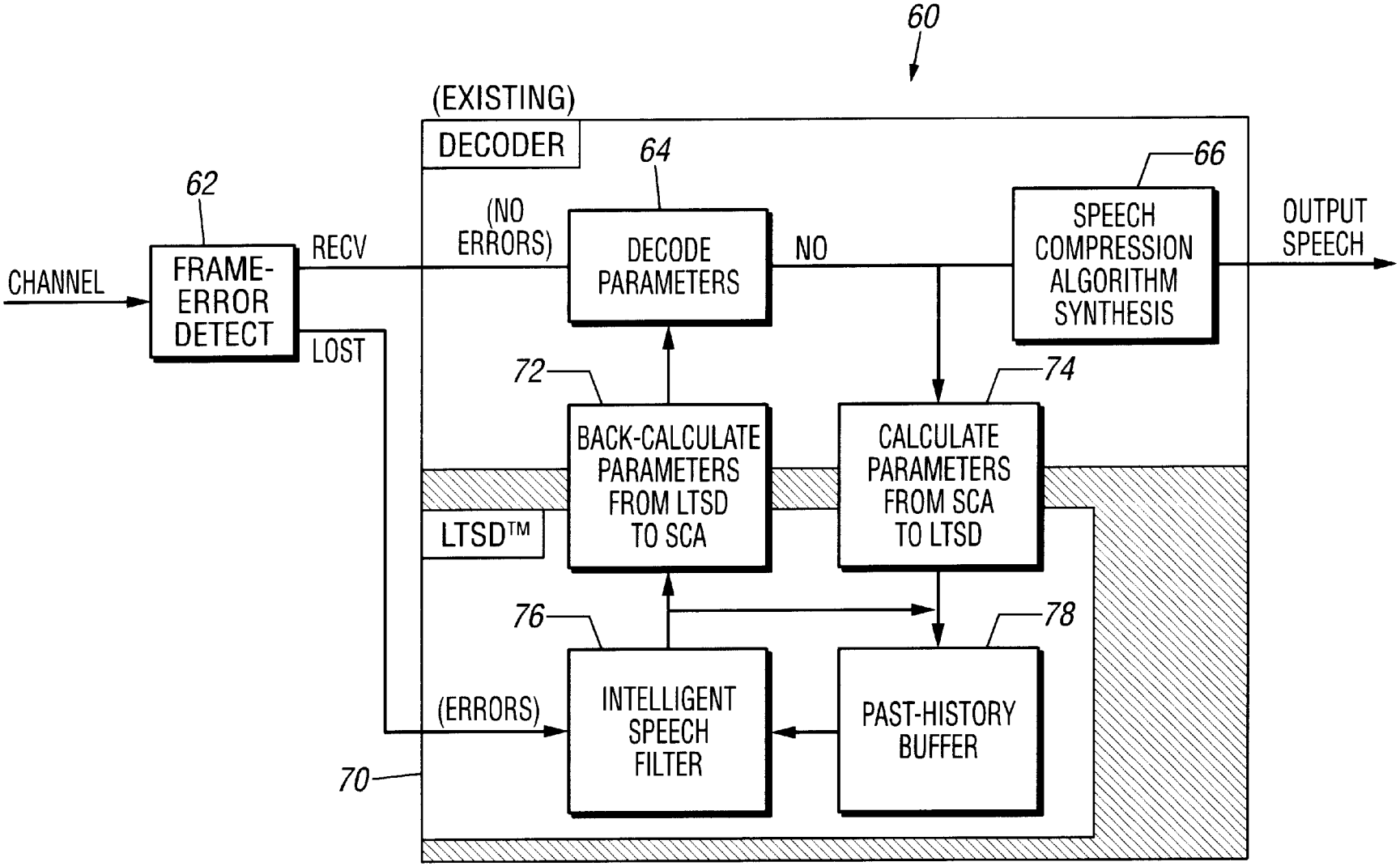
FIG. 6 illustrates the functional arrangement of an SCA decoder that is modified with an embodiment of the present invention.
Figure 7:
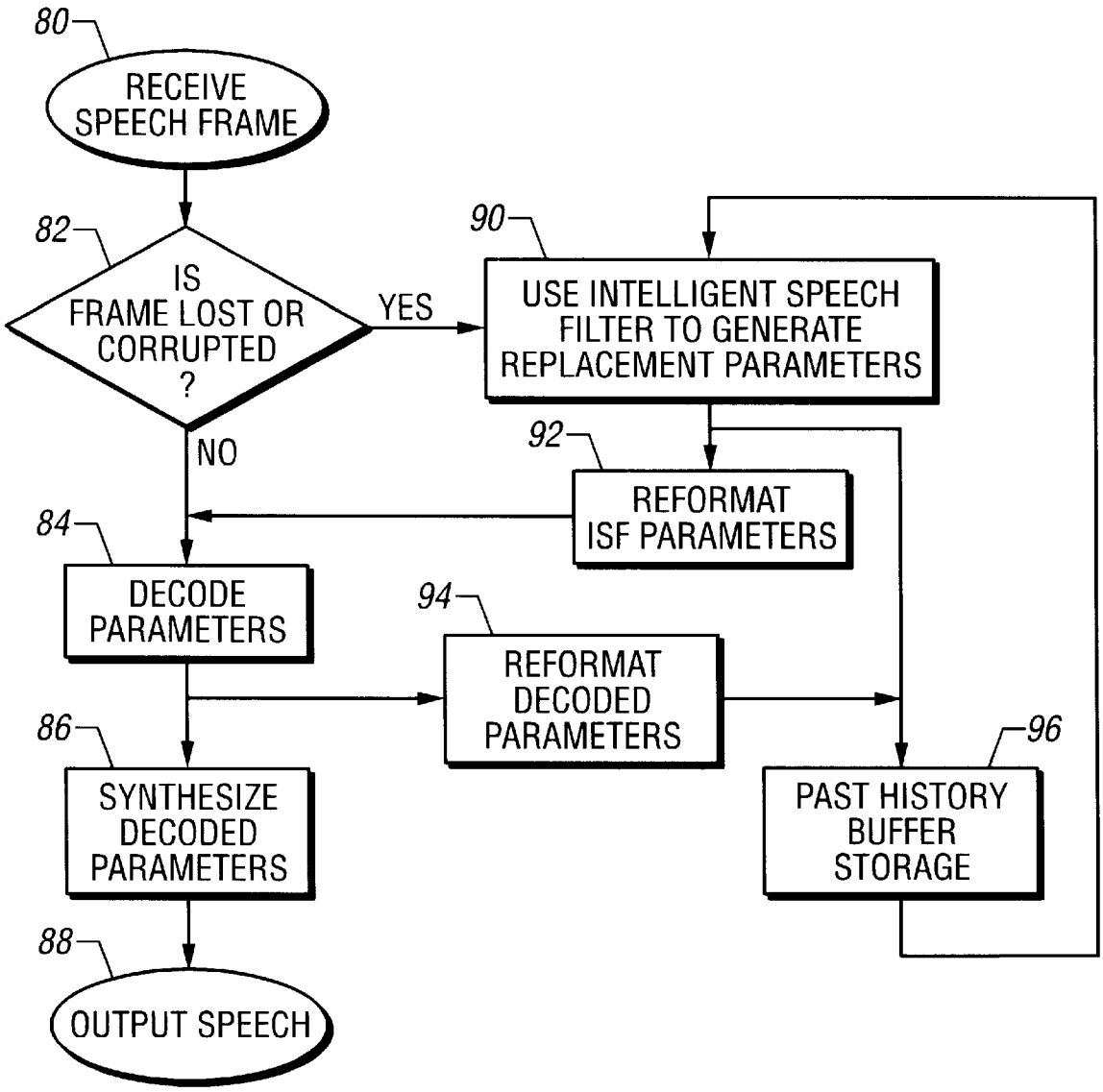
FIG. 7 is a flow diagram of the general operation of an embodiment of the present invention.

FIG. 6 show the general arrangement of functional elements of the decoder 60 with the LTSD 70 of the present invention that composes the decoding side of the digital transmission. FIG. 7 shows the steps of operation. As with prior art decoders, the decoder 60 has an error control detector 62 which is used to detect lost or corrupted speech frames (corresponding to error control decoder device 38 in FIG. 3). As with all SCA devices, a parameter decoder 64 is provided which reverses the process of the SCA coder 56 of FIG. 5. Properly decoded speech frames are sent to the SCA synthesizer 66 which outputs the reconstructed speech to the listener. The elements comprising the LTSD 70 of the present invention are the intelligent speech filter (ISF) 76, which generates extrapolated parameters that replace the lost or corrupted parameters detected by the error control detector 62. The LTSD 70 also has a buffer 78 that stores the past-history speech information. The ISF 76, which is a collection of FIR multi-layer feed-forward neural networks (MFFNN), uses the information in the past-history buffer 78 for the generation of extrapolated parameters that replace the lost or corrupted parameters. Pre-and post-processing of the ISF 76 data are handled by two calculation devices, 72 and 74. The back-calculation device 72 is used to reformat the output of the ISF 76 into a format that is readable by the parameter decoder 64. The calculation device 74 is used to reformat, continuously, the output of the parameter decoder 64 into a format suitable for the past history buffer 78. Note that the LTSD 70 of the present invention is located in the receiver/decoder so that the SCA bit-stream (shown in FIG. 4) is not modified. This arrangement, and the use of the back-calculation 72 and calculation device 74, enables the LTSD 70 to be used with a variety of SCA devices.

FIG. 7 shows the operation of this embodiment of the present invention. In step 80, the input bit-stream that composes the speech frame is received. Many SCA decoders are setup to decode and frame-fill the frame, even if the frame has bit-errors. For this reason, in step 82, the received bit-stream is interrogated in order to determine if it is lost or corrupted. If the frame is deemed correctly received, then, in step 84, the parameters are decoded to reverse the process of the SCA coder 56 of FIG. 5. In step 84, the voicing probability, the gain, the pitch, and the line-spectral pairs (LSP) are available. The LSPs are converted to all-pole coefficients, which are then converted to cepstral coefficients. In step 86, the decoded parameters are synthesized in order to convert the decoded parameters into speech signal voltages that are then output to the listener in step 88. In the event that the received frame is lost or corrupted, then a replacement speech frame is generated in step 90 within the intelligent speech filter. The output of the intelligent speech filter is first reformatted in step 92 to conform to the input format of the parameter decoder (64 of FIG. 6), and then routed to the parameter decoder for the performance of step 84 as above. In all cases, the output of step 84 is stored in the past history buffer during step 96 after first being reformatted to conform to the format of the past-history buffer in step 94. The information stored in the past history buffer (78 of FIG. 6) is used in step 90 for the generation of replacement speech frames. Replacement speech frames generated during step 90 are also routed to the past history buffer and stored within the buffer during step 96. With this method, the listener will not normally notice that a speech frame has been lost because of the smooth transition between the last-received, lost, and next-received speech frames.

An embodiment of the present invention is connected to the STC at 2400 bps to create the LT-STC. The LT-STC program is ported to an electronic programmable read-only memory (EPROM) module for installation on the C31-based board. Power is provided in a stand-alone mode, e.g., with a cellular battery. The present invention can be modified to function with other speech compression algorithms.

An embodiment of the present invention uses a matrix of finite-impulse response (FIR) filters expanded into the input and hidden layers of a multi-layer feed-forward neural network trained by the well-known back-propagation algorithm in order to extrapolate each of the SCA parameters. The back-propagation neural network training is based on an "iterative version of the simple least-squares method, called a steepest-decent technique." See J. A. Freeman, D. M. Skapura, "neural Networks—Algorithms, Applications, and Programming Techniques," Addison Wesley Publishing Company, Reeding Mass., 1991. The preferred embodiment of the present invention employs an "intelligent speech predictor" in which the movement of the vocal tract and other speech parameters are continued for the generation of speech frames that substitute lost speech frames.

The Concealment Technique

During step 84 of FIG. 7, if the frame has been received (or a replacement frame generated by the ISF), then the cepstral coefficients are converted to a linear magnitude spectral envelope, and the present invention will process the frame in step 94 in order to un-queue the necessary information for the past-history buffers for each of the STC parameters.

Figure 8:
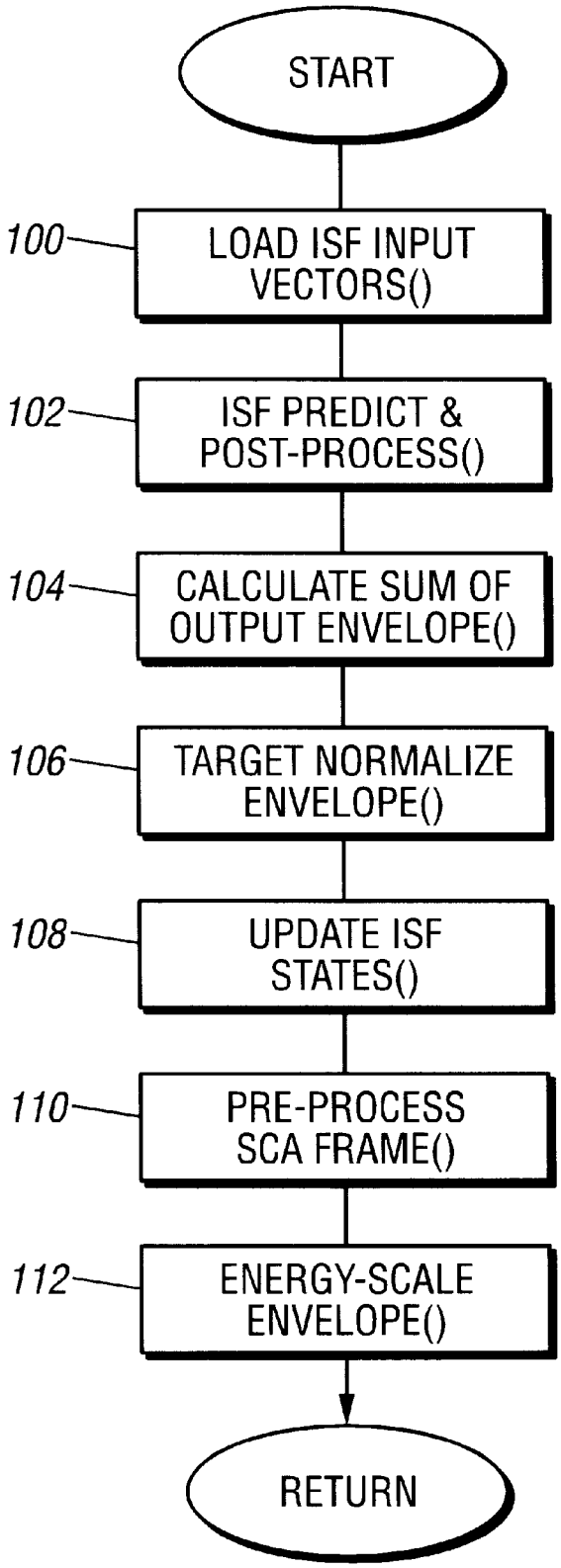
FIG. 8 is a flow diagram of the functional process of an embodiment of the present invention that generates replacement speech frame parameters in the event that a speech frame is lost or corrupted.

The details of step 90 of FIG. 7 are illustrated in FIG. 8. The first step 100 in the extrapolation phase is to load up the input vectors to the MFFNN. In the next step 102, the intelligent speech filter (ISF) prediction and post-processing is performed in order to determine the extrapolation parameters. In step 104, the sum of the extrapolated envelope magnitudes is calculated (at multiples of $F_{int}$=15.67 Hz frequencies of observation). In step 106, the target envelope is normalized to ensure that the extrapolated envelope is a probability mass function (PMF) (i.e., the sum of the envelope component is equal to one). In the fifth step 108, the "states" of the system, such as voice-activity, voicing, energy states, and the number of consecutive lost and received frames are all updated. Sixth, in step 110, all of the required SCA frame inputs to the MFFNN's are pre-processed and stored in the past-history buffer for each required SCA parameter. Finally, in step 112, the extrapolated spectral envelope is scaled to the extrapolated energy (or gain) for the current frame. This concludes the steps necessary for frame-error concealment for the current lost frame.

FIR Multi-layer Feed-Forward Networks (MFFNN)

The finite-impulse response (FIR) multi-layer feed-forward neural network (MFFNN) can be transformed into a "standard" MFFNN that may be trained by back-propagation by adding additional input nodes for each one of the tap-delayed signals used. The addition of input nodes is commonly done, for example, in the time-delayed neural network (TDNN).

The following section is borrowed from Simon Haykin's chapter on Temporal Processing. See Simon Haykin, "Neural Networks, A Comprehensive Foundation," McMillan College Publishing Company, New York, 1994. Some of the contents presented in the Haykin text have been modified to make it more relevant to the design of the present invention.

The standard back-propagation algorithm may also be used to perform nonlinear prediction on a stationary time series. A time series is said to be stationary when its statistics do not change with time. It is known however that time is important in many of the cognitive tasks encountered in the real-world, such as vision, speech, and motor control. It may be possible to model the time-variation of signals if the network is given the dynamic properties of the signal.

For a neural network to be dynamic, it must be given memory. This memory may be in the form of time-delays as extra inputs to the network (i.e. a past-history buffer). The time-delayed neural network (TDNN) topology is actually a multi-layer perceptron in which each synapse is represented by an FIR filter. For its training, an equivalent network is constructed by unfolding the FIR multi-layer perceptron in time, which allows the use of the standard back-propagation algorithm for training.

Figure 9:
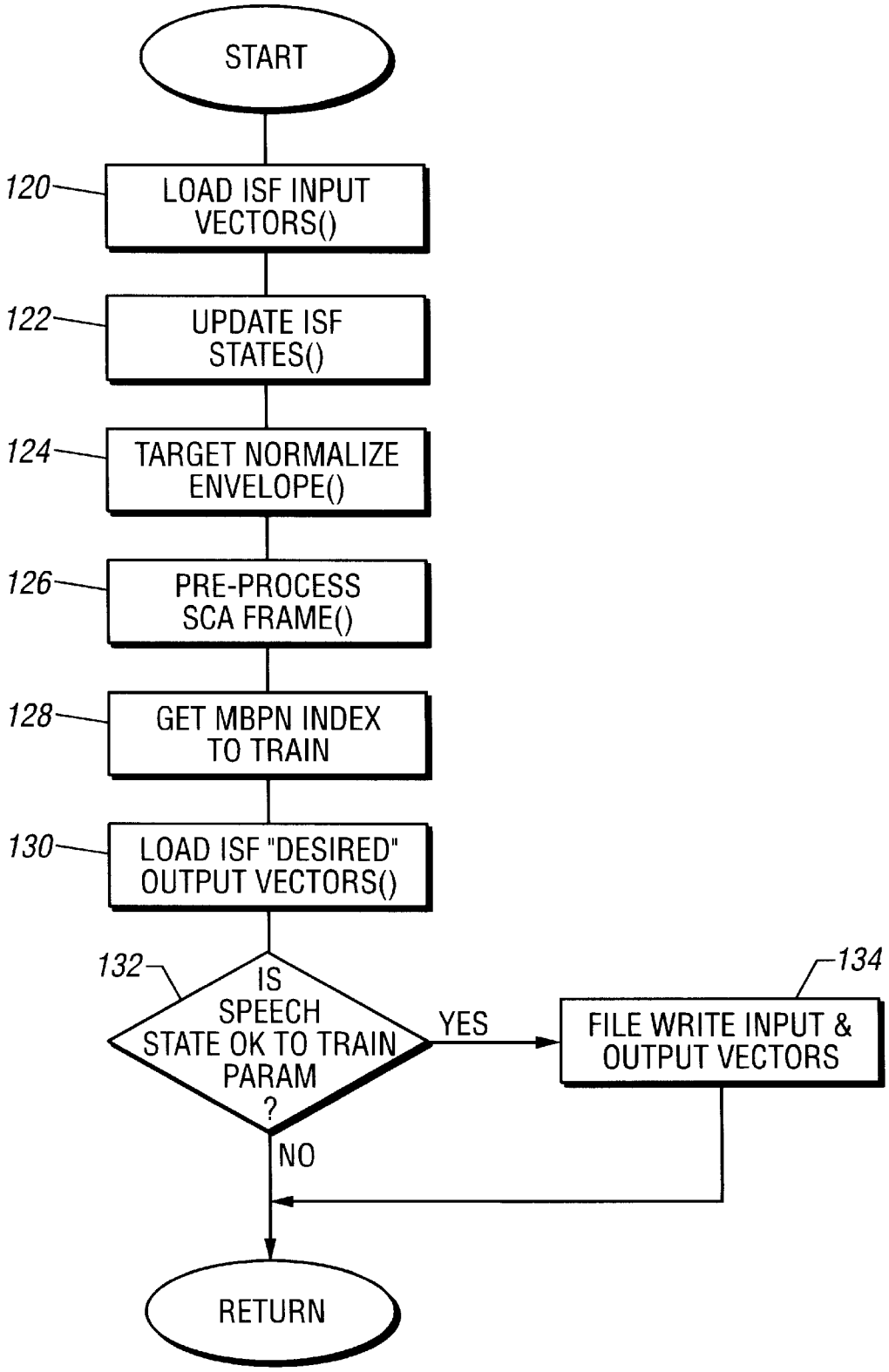
FIG. 9 is a flow diagram of the functional process that trains the neural network of and embodiment of the present invention.

The training steps are shown in FIG. 9. The first step 120 in the training phase is to load the input vectors into the MFFNN. In the second step 122, the "states" of the system, such as voice-activity, voicing, energy states, and the number of consecutive lost and received frames are all updated. In the next step 122, the intelligent speech filter (ISF) prediction and post-processing is performed in order to determine the extrapolation parameters. In step 124, the target envelope is normalized to ensure that the extrapolated envelope is a probability mass function (PMF) (i.e., the sum of the envelope component is equal to one). In step 126, all of the required SCA frame inputs to the MFFNN's are pre-processed (reformatted). In step 128, the MBPN index needed for training is obtained. In step 130, the "desired" output vectors for the ISF are loaded. In step 132, it is determined if the speech state is proper for the training parameters. If so, then the input and output vectors are stored as a valid training set in step 134, otherwise, the vectors are discarded.

Figure 10:
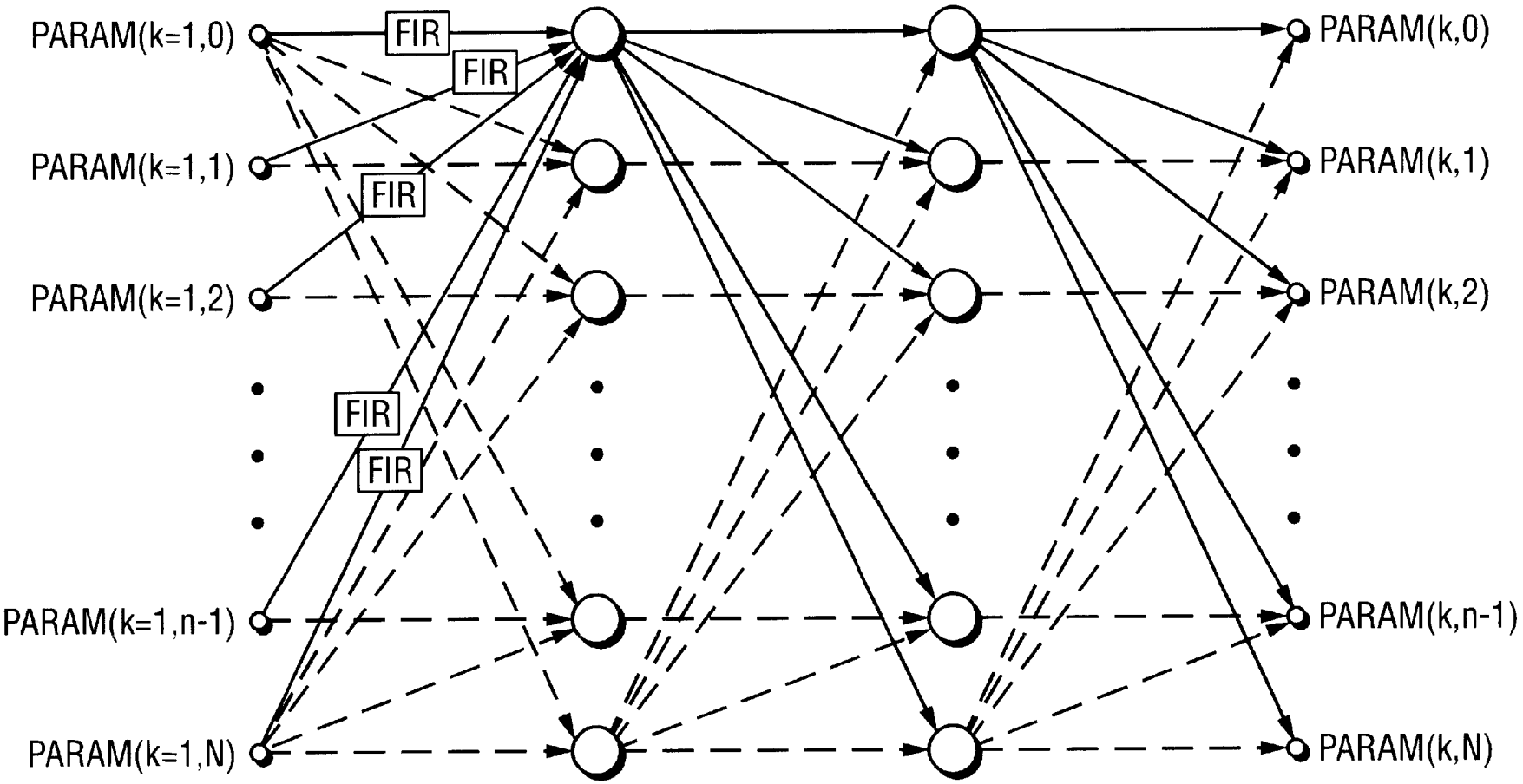
FIG. 10 (Prior Art)
FIG. 10 illustrates the architecture of a finite-impulse response (FIR) multi-layer feed forward neural network (MFFNN) of an embodiment of the present invention.

Therefore, the FIR multi-layer perceptron is a feed-forward network which attains dynamic behavior by virtue of the fact that each synapse of the network is an FIR filter. The architecture used by the present invention is shown in FIG. 10, which is similar to the FIR multi-layer perceptron except that only the input layer synapses use the tap-delays as inputs, therefore forming the FIR component of the network.

The MFFNN is trained in an "open-loop adaptation scheme" before it is needed in the real-time application. Once the network is trained, the weights are "frozen," and the "real-time" application performs the extrapolation by performing a recursive "closed-loop" prediction for all lost-frames until a frame is actually received. In other words, a "short-term" prediction of the SCA parameter is computed for each lost frame "k" by performing a sequence of one-step predictions that are fed back into the past-history buffers of all of the networks using the SCA parameter. The second dimension for prediction "n" is the frequency index, and is used only for the vocal tract parameters (i.e. the spectral envelope). For more information on neural networks and temporal processing, see Daykin, pp. 498–533. The next section describes the "heart" of the frame-error concealment technique of the present invention.

The Intelligent Speech Filter (ISF) Design

This section describes the core process of the LTSD frame-error concealment technique, the intelligent speech filter (ISF). The ISF is composed of six "optimized" non-linear signal processing elements implemented in Multi-layer Feed Forward Neural Networks (MFFNN).

The largest tap-delay value gives the "order" of prediction of the unwrapped FIR filter. In each case, a 4th-order FIR filter implementation for each extra SCA parameter was used at the respective input layers. The four taps represent 60 ms of past-history used for the extrapolation of the current 15 ms sub-frame "k". There are two 15 ms sub-frames per transmitted 72 bits (30 ms) frame, so that the ISF makes two extrapolations for each transmitted frame. The spectral envelope inputs only used 2-tap-delay FIR filters, or 30 ms for the extrapolations. An increase in the number of taps could be used for an increase in performance of the spectral envelope extrapolation, but this would increase the hardware requirements beyond a "real-time" capability (using currently available hardware).

Figure 11:
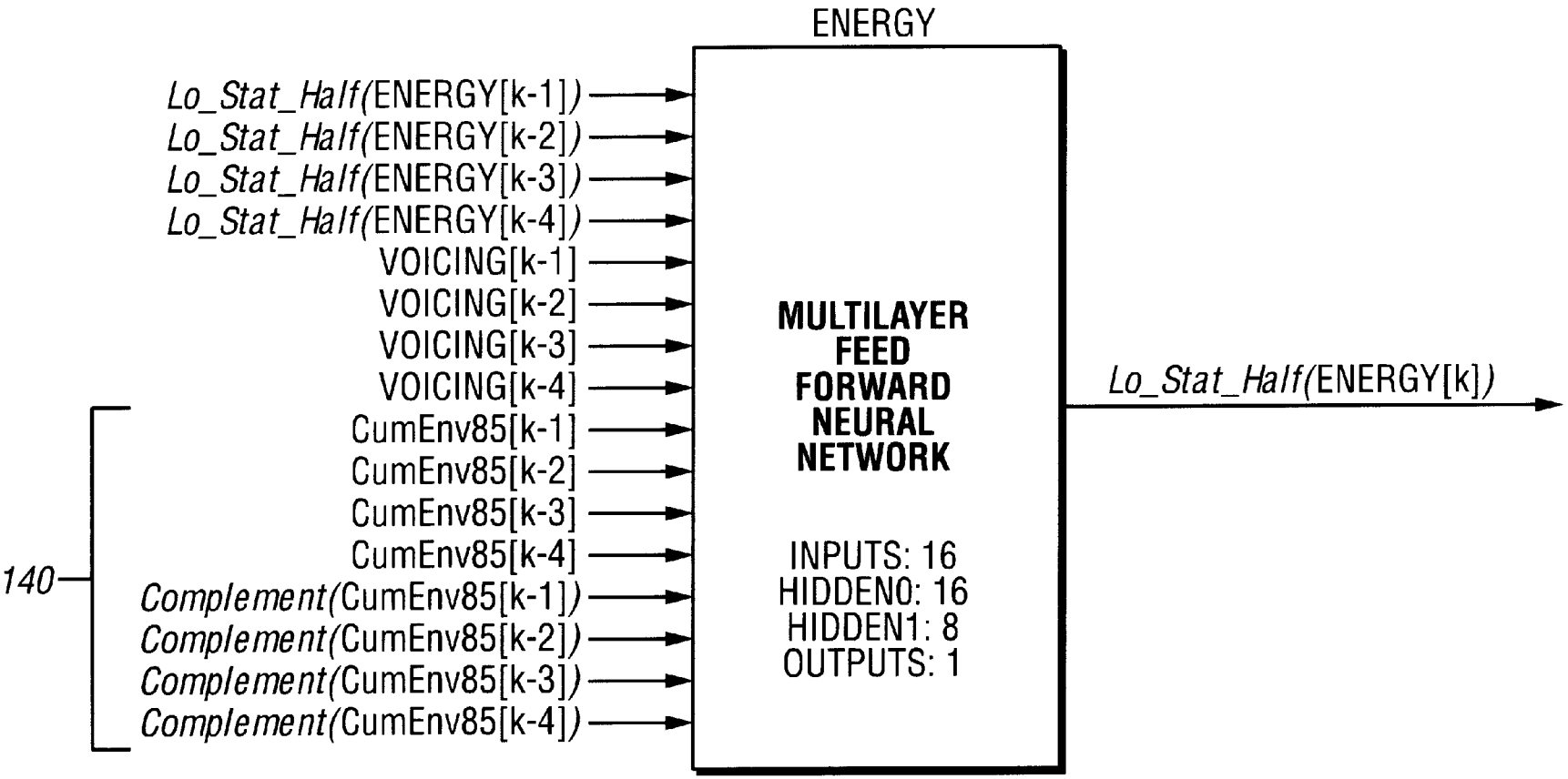
FIG. 11 shows the input/output arrangement of the energy neural network of an embodiment of the present invention.
Figure 12:
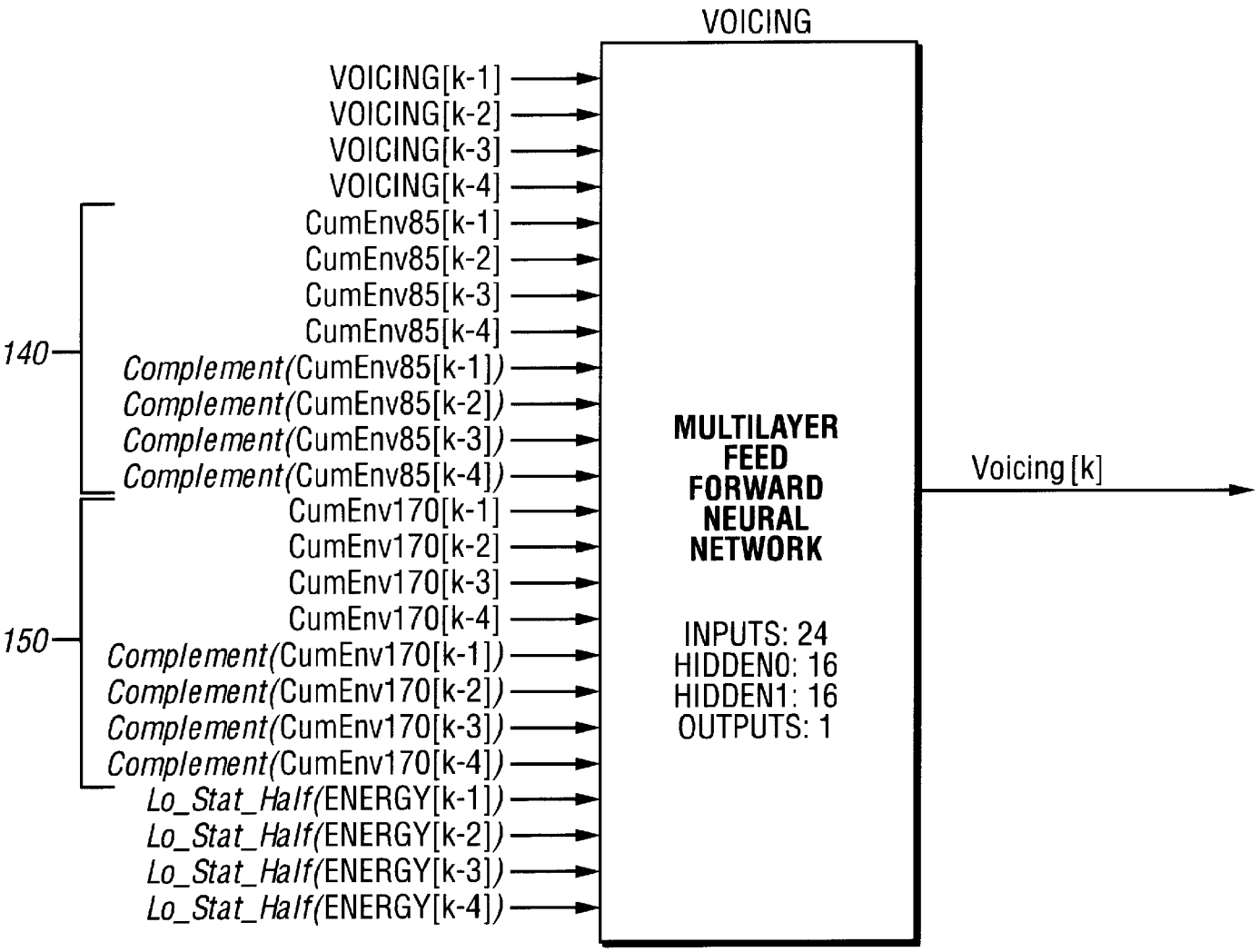
FIG. 12 shows the input/output arrangement of the voicing neural network of an embodiment of the present invention.
Figure 13:
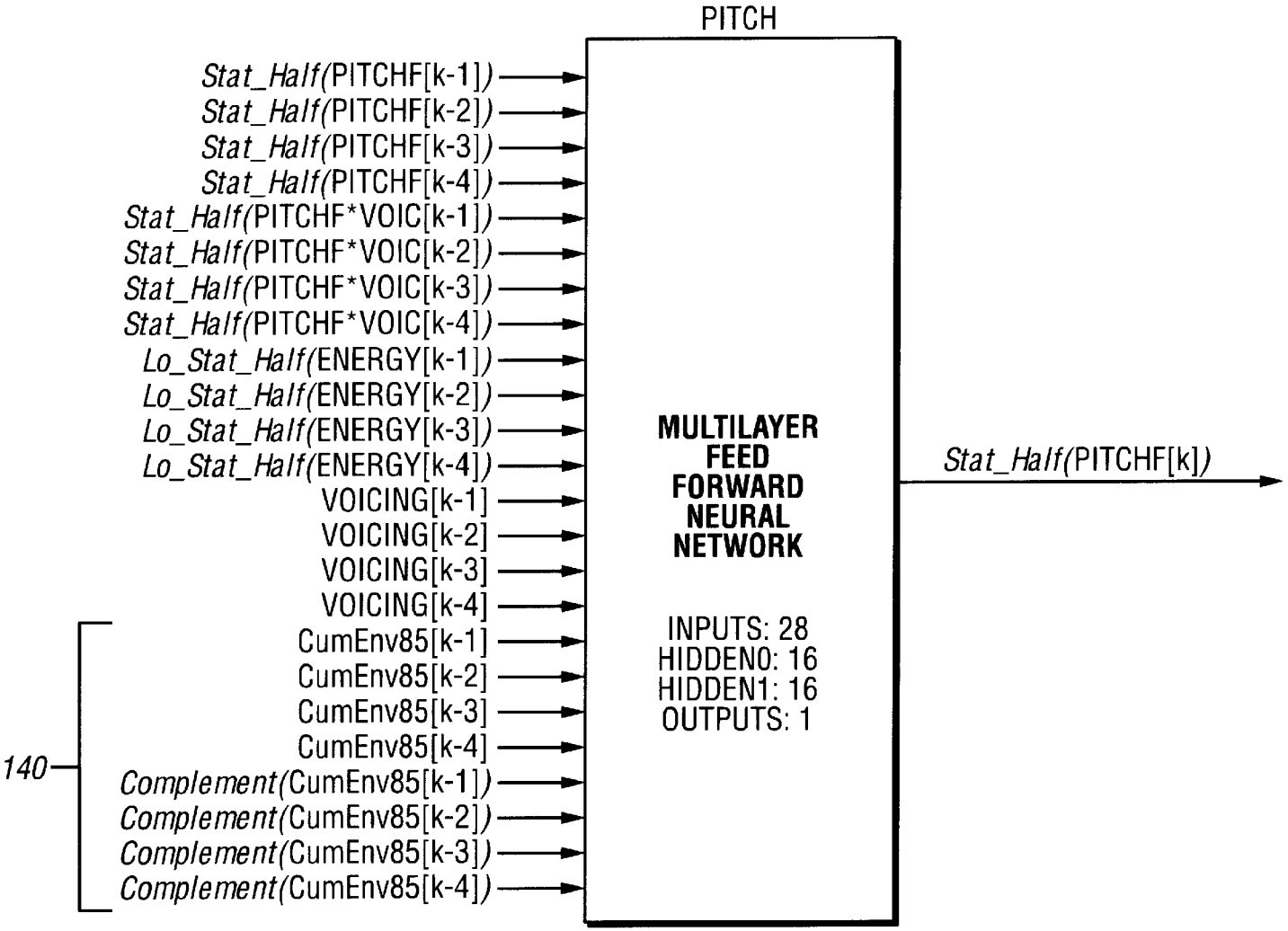
FIG. 13 shows the input/output arrangement of the pitch neural network of an embodiment of the present invention.

In each case, inputs from other SCA parameters are used to characterize the current state of the dynamics of speech, which identify the phoneme (actually, the "phone" or actual sound made) and speaker characteristics needed for a "quality" extrapolation. For instance, the energy level of the lost frame is a function of past energy values, the level of the excitation source of the recent past (i.e. voicing), and the shape of the vocal tract. As shown in FIG. 10, each one of the SCA parameters is assigned to an MFFNN for parameter extrapolation, where "k" is the frame index, and "n" is the frequency index for the spectral envelope parameters. Specific input and output parameters for the SCA parameters "Energy," "Voicing," and "Pitch" are shown in FIGS. 11, 12 and 13, respectively.

Figure 14:
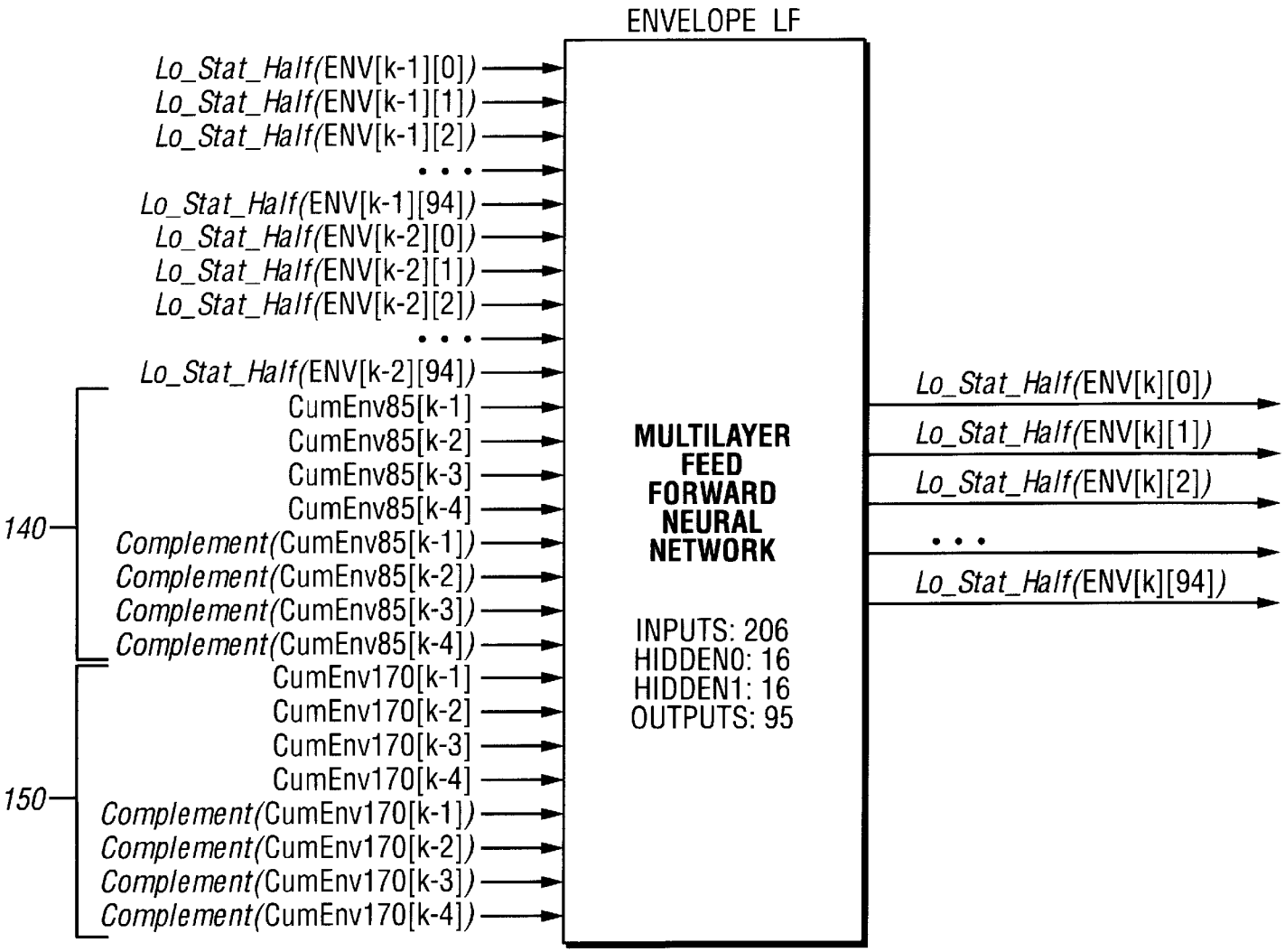
FIG. 14 shows the input/output arrangement of the low frequency (LF) envelope neural network of an embodiment of the present invention.
Figure 15:
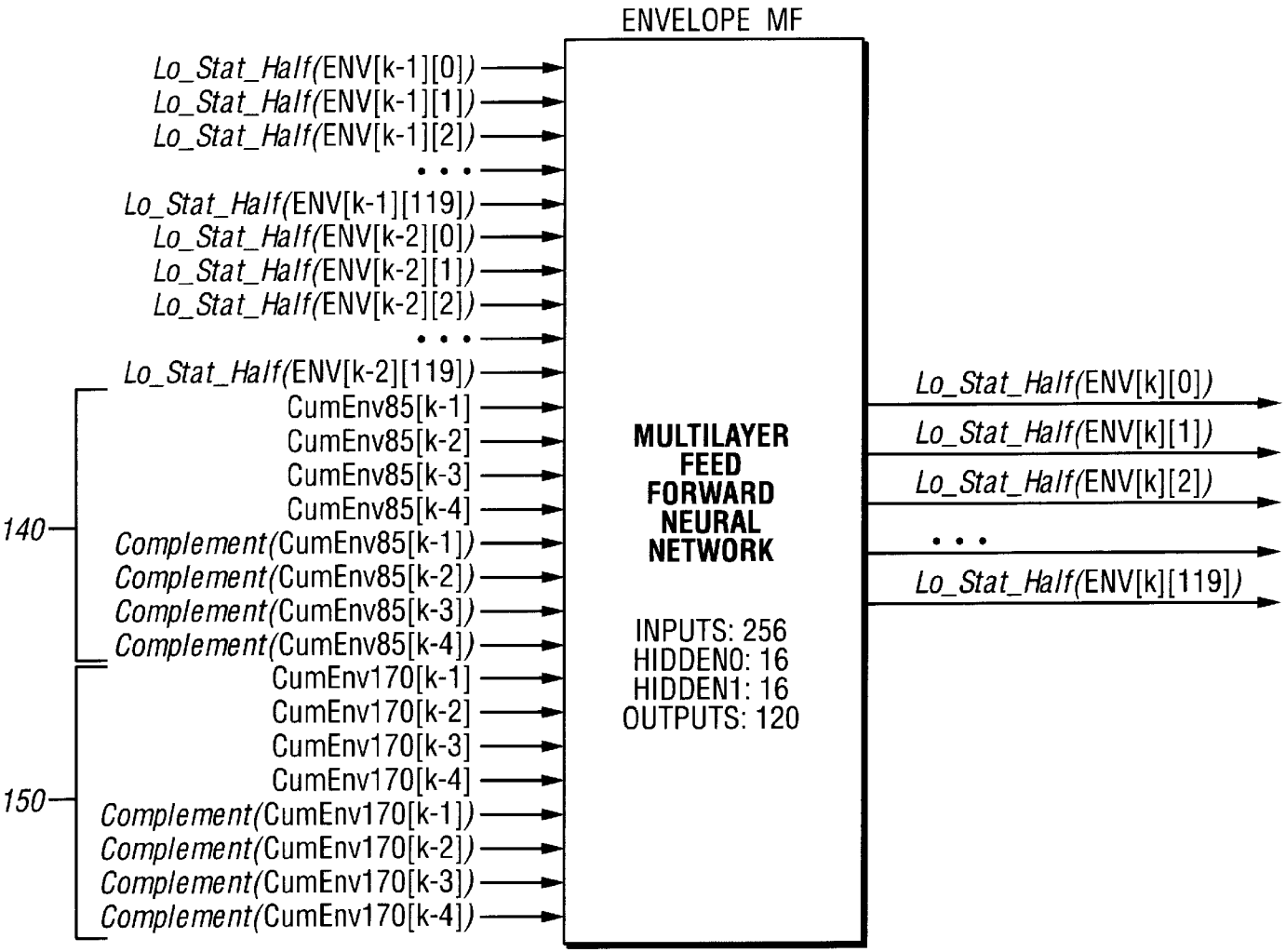
FIG. 15 shows the input/output arrangement of the medium frequency (MF) envelope neural network of an embodiment of the present invention.
Figure 16:
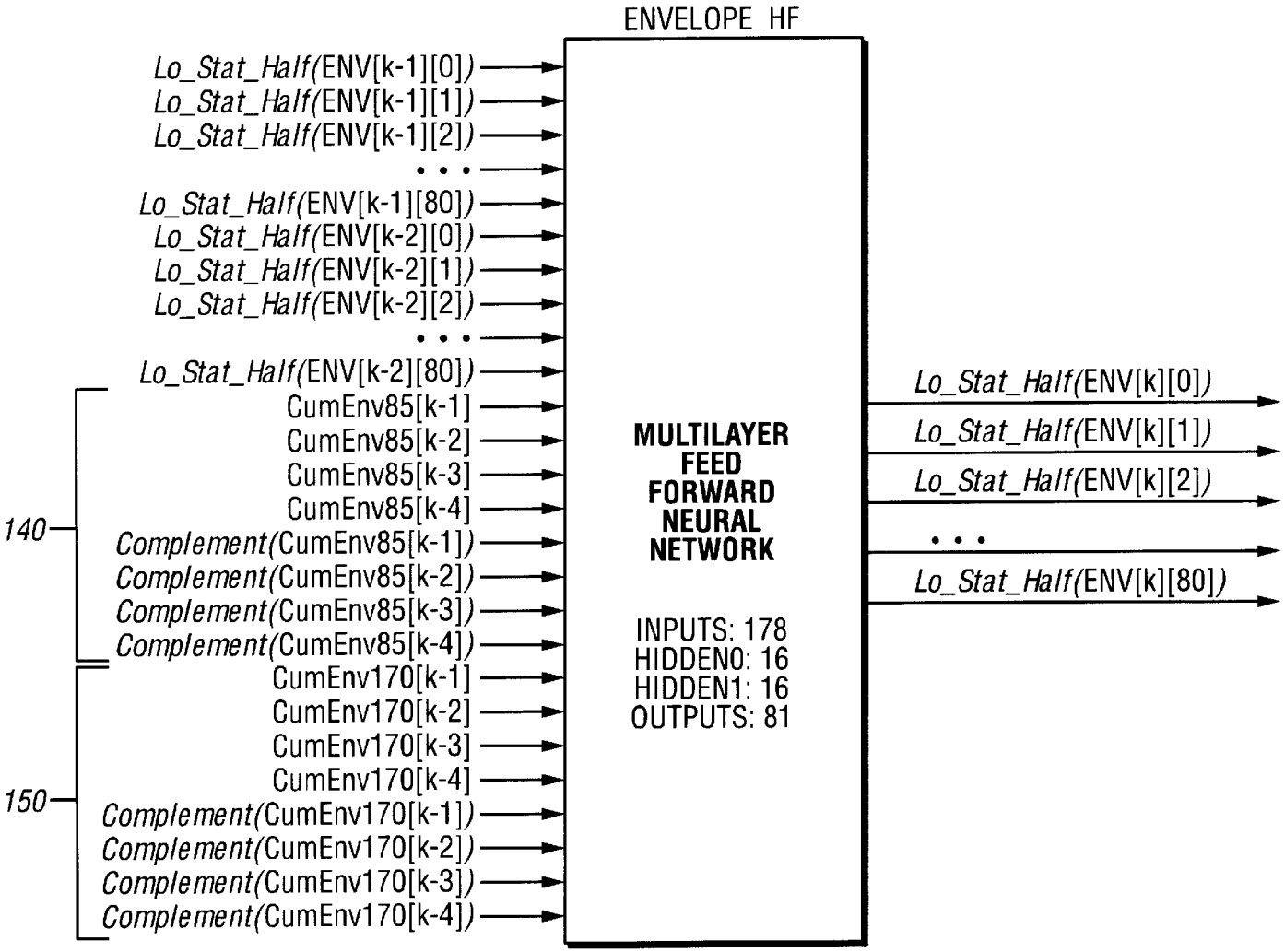
FIG. 16 shows the input/output arrangement of the high frequency (HF) envelope neural network of an embodiment of the present invention.

The frequency spectrum was subdivided into three frequency bands: Low, Mid and High-Frequency. The bands are used to decrease the memory and processing requirements, and also to allow the networks to "specialize" within their band. Specific input and output parameters for the "Low," "Medium," and "High" are shown in FIGS. 14, 15 and 16, respectively. The general shape of the other bands is contained in the CumEnv85 140 and CumEnv170 150 parameters, which represent the cumulative percent energy density of the PMF-normalized spectral envelope up to the 85 and 170 frequency indices (corresponding to 1328.125 and 2656.25 Hz). Each frequency band overlaps into its adjacent band by 156.25 Hz at the input to the MFFNN. In each case, the lower frequency band is used to replace the output magnitudes in overlapping frequencies. A "hard" transition between bands was used at the output to go from one band to the next. For example, the output of the LF-band MFFNN (FIG. 14) was used all the way up to the 94th index (1468.75 Hz). The output from the MF-band MFFNN (FIG. 15) was used from 95th to the 215th frequency index, and so on. In an embodiment of the present invention, there are occasional sharp discontinuities between the frequency bands. The discontinuities can be "smoothed" out by the envelope-to-cepstral conversion.

The dimensions of each MFFNN are shown in FIGS. 11–16. The following section discusses the SCA parameter pre-processing, and the SCA parameter post-processing which correspond to steps 94 and 92, respectively, of FIG. 7 and steps 110 and 102, respectively, of FIG. 8. Finally, details of the training procedure of FIG. 9 is discussed.

SCA Pre- and Post-Processing

The received spectral envelope is first converted to a probability mass function (PMF) by dividing each magnitude by the total sum over all frequencies. This creates an input vector of magnitude one. After this process, each of the SCA parameters including the envelope are pre-processed based on the input statistics.

Two pre-processing transformations are used to convert the data into a form suitable for the MFFNN. Both pre-processing transformations are implemented for "real-time" and "train-set" modes. The ISF implements mapping routines that are dynamically allocated and configured to a SCA parameter are from an ISF initialization file. With the mapping transformations identified for each SCA parameter, they are then initialized.

The post-processing functions implement the inverse of the pre-processing functions.

ISF Training Procedure

The training sets are gathered for each of the SCA parameters (in the STC they are envelope, voicing, pitch, and energy), and the FIR Multi-layer Feed-Forward Network is trained by the well-known back-propagation algorithm with a momentum term. The output nodes for all networks are linear, and bias nodes (which have a constant input of 1) were added to each of the layers. The weights are initialized to uniformly distributed positive random numbers from ~U[0.0, 2.4/(Number of Inputs)].

As discussed in the previous section, the spectral envelope frequency band was divided into three bands. The following table lists the characteristics of each network, and information concerning the training process. Suitable neural network training may be performed on a specialized 16-processor single-instruction multiple data machine built by HNC Software, called the SNAP-16. The SNAP is connected to the workstation S-bus through a VME bus and has a peak processing rate of 640 MFLOPS (actual floating-point arithmetic speeds depend on how efficiently the network can be divided amongst the 16 processors). The HNC software called Neurosoft, and the Multilayer Backpropagation Network routines can be used without modification. See "HNC SIMD Numerical Array Processor User's Guide for Sun Products," April 1994.

The training of a network actually involves a weight update phase (according to back-propagation) and a testing phase, where the weights are held constant and a mean-squared error (MSE) is calculated. Once the networks is trained, the weights file is read for forward propagation on the workstation.

In each case, the set of weights that generate the smallest test-set mean-squared error (MSE) are saved. Pre-selected learning rates are used for starting values. The learning rates are then decreased until the MSE does not change. Once the test-set MSE does not change, then the learning rates are increased again and training proceeds as before. If the test-set MSE does not change within a pre-defined tolerance, then the training process is stopped. Note that the number of training passes per test iteration may be different for each of the SCA parameters, and not all of the input training vectors are saved to the training and test sets.

Finally, the above-discussion is intended to be merely illustrative of the invention. Numerous alternative embodiments may be devised by those having ordinary skill in the art without departing from the spirit and scope of the following claims.

What is claimed is:

1. A loss-tolerant speech decoder that receives speech frame parameters according to a speech compression algorithm, said decoder comprising:

a frame error detector, said frame error detector capable of discriminating between properly received speech frame parameters and parameters that are lost or corrupted, said frame error detector further capable of issuing a signal upon receipt of lost or corrupted speech frame parameters, a parameter decoder, said parameter decoder capable of decoding said received speech frame parameters to make decoded speech frames, a buffer, said buffer used to store a history of said decoded speech frames received by said buffer from said parameter decoder, a speech filter, said speech filter capable of generating replacement speech frame parameters that are written to said parameter decoder upon issuance of said signal from said frame error code detector upon receipt of a lost or corrupted speech frame, wherein said replacement speech frame parameters take the place of lost or corrupted speech frame parameters received by said decoder in order to conceal said lost or corrupted speech frame parameters.

2. A speech decoder as in claim 1 wherein said speech filter has a plurality of neural networks.

3. A speech decoder as in claim 2 wherein said neural networks are multi-layer feed-forward neural networks.

4. A speech decoder as in claim 3 wherein said neural networks are finite-impulse response multi-layer feed-forward neural networks.

5. A speech decoder as in claim 2 wherein said neural networks are trained by the back-propagation method.

6. A speech decoder as in claim 5 wherein said back-propagation training includes the addition of input nodes.

7. A speech decoder as in claim 2 wherein at least one neural network is designated for the energy characteristics of said speech frame parameters.

8. A speech decoder as in claim 2 wherein at least one neural network is designated for the voicing characteristics of said speech frame parameters.

9. A speech decoder as in claim 2 wherein at least one neural network is designated for the pitch characteristics of said speech frame parameters.

10. A speech decoder as in claim 2 wherein at least one neural network is designated for the low frequency envelope characteristics of said speech frame parameters.

11. A speech decoder as in claim 2 wherein at least one neural network is designated for the medium frequency envelope characteristics of said speech frame parameters.

12. A speech decoder as in claim 2 wherein at least one neural network is designated for the high frequency envelope characteristics of said speech frame parameters.

13. A speech decoder as in claim 2 wherein said speech filter generates replacement speech frame parameters based upon said history of said decoded speech frames stored in said buffer.

14. A speech decoder as in claim 1 wherein said buffer receives decoded speech frame information from said speech filter.

15. A speech decoder as in claim 1 wherein a speech compression algorithm synthesizer receives decoded parameters from said parameter decoder and transforms said decoded parameters into speech signal voltages that are then output to a listener.

16. A speech decoder as in claim 1 wherein said replacement speech frame parameters from said speech filter are reformatted in a back-calculation device to conform to an input format of said parameter decoder before said replacement speech frame parameters are written to said parameter decoder.

17. A speech decoder as in claim 1 wherein said decoded parameters received by said parameter decoder are first reformatted in a calculation device to conform to a format acceptable to said buffer before being stored in said buffer.

* * * * *